343-909 SR
11/21/78 OR 4,126,866

United States Patent [19]
Pelton

[11] 4,126,866
[45] Nov. 21, 1978

[54] SPACE FILTER SURFACE

[75] Inventor: Edward L. Pelton, Columbus, Ohio

[73] Assignee: Ohio State University Research Foundation, Columbus, Ohio

[21] Appl. No.: 797,797

[22] Filed: May 17, 1977

[51] Int. Cl.[2] ..... H01Q 1/42
[52] U.S. Cl. ..... 343/909; 343/872
[58] Field of Search ..... 343/754, 767, 770, 771, 343/909, 872, 18 A, 18 B

[56] References Cited

U.S. PATENT DOCUMENTS

| | | | |
|---|---|---|---|
| 3,769,623 | 10/1973 | Woo et al. | 343/909 |
| 3,789,404 | 1/1974 | Munk | 343/872 |
| 3,842,421 | 10/1974 | Rootsey et al. | 343/909 |
| 3,975,738 | 8/1976 | Pelton et al. | 343/872 |
| 3,978,486 | 8/1976 | Reinders et al. | 343/909 |

*Primary Examiner*—Alfred E. Smith
*Assistant Examiner*—David K. Moore
*Attorney, Agent, or Firm*—Sidney W. Millard

[57] ABSTRACT

A surface used as a space filter in electromagnetic space. The filter surface is formed as a periodic array of recurrent filter components clustered in groups of three each incorporating pairs of elements extending outwardly at an internal angle of 120°. A reactive load present as a U-shaped loop is coupled with the terminal portions of each element and extends outwardly therebetween.

13 Claims, 19 Drawing Figures

SPACE FILTER SURFACE

The invention described herein was made in the course of work done under a contract from the U.S. Air Force.

BACKGROUND

Investigators have expended considerable effort in the study of surfaces in space which are selectively passive to the transmission of electromagnetic energy. These surfaces are configured as thin periodic arrays of either slots or dipoles. In consequence of Babinet's principle, the results of theoretical analysis of the former find direct applicability to the latter.

Collectively, periodic arrays of slots or dipoles function as band-filters of electromagnetic radiation. Conceptualized from a circuit standpoint, periodic arrays of dipoles are band-stop, or reflection filters. Within their operating band, properly designed periodic arrays of dipoles reflect incident signals in a manner comparable to a highly conducting solid metal surface. Outside of this reflection band, however, incident signals pass through the array of dipoles. Periodic arrays of slots perform a complementary roll with respect to dipole arrays. For example the periodic slot arrays function as an electromagnetic window within their operating band, i.e. they are band-pass devices permitting the incident electromagnetic signals to pass through the array. Outside of the operating band, such arrays become opaque, serving to reflect the incident signals.

A variety of applications utilizing these space filters have been proposed. For example, a periodic array of dipoles can be employed to replace the solid metal surface for applications in which an extended reflection bandwidth is not needed or may be undesirable. Arrays of crossed dipoles have been employed as a Cassegrain subreflector in a dual-frequency antenna system, while arrays of slots have been applied in the design of radomes, particularly those intended for use with aircraft. Such radomes promise several operational improvements. For example, conventionally structured aircraft radomes, formed of rigid dielectric or ceramic materials, may develop precipitation noise at high speeds and occasioned by static charge buildup and subsequent discharge to the airframe. Such discharge has represented a hindrance to the performance of enclosed equipment. Reflection lobe phenomena are typically encountered in most applications, and as requirements for scan angle flexibility have enlarged, a variety of effects are encountered. For instance, a transmission loss and phase distortion may be witnessed. Further, the equipment enclosed by more conventional radomes is susceptible to lightning damage as well as to thermal problems developed by poorly controlled frictionally induced skin heating.

Metallic radomes promise such advantages as the elimination of precipitation noise, inherent lightning protection, improved shielding against spurrious low frequency pulses due to the above-noted band-pass filter characteristics; and a potentially improved mechanical strength. However, due to aerodynamic design constraints, the geometric shapes which the radomes must assume (for example, ogival or conical) have developed a need to accommodate relatively large scan angles of incidence.

One slotted array structure contemplated for use within aircraft radomes is described in U.S. Pat. No. 3,975,738. See also the following publication.

I. Pelton, E. L. and B. A., Munk, "A Streamlined Metallic Radome," IEEE Transactions on Antennas and Propagation, Vol. APA-22 No. 6, Nov. 1974, pp. 799–803.

The slot elements of the array there described are in a general "Y" shape, each slot element being formed as a continuous geometric shape with adjacent outwardly disposed arms being arranged at angles of 120° with respect to each other. The reactive loading achieved with the noted geometry achieves a frequency-stable pass for a broad range of incident signals and accommodates polarization variations. However, the structure, which must be formed by chemical etching, requires a supportive substrate inasmuch as "islands" of conductive or metallic material are situated within each cluster of the noted arms. This feature necessarily poses a limitation upon the strength of any radome utilizing the design and requires the presence of a supporting dielectric substrate. As is apparent, the mechanical integrity of the slot structure is impaired with such an arrangement.

Another structure configured to avoid difficulties encountered due to incidence angle variations is described in U.S. Pat. No. 3,789,404. In this document arrays are described comprising resonant short dipole elements of length less than one half wavelength which are loaded in the manner of a two-wire transmission line. Further, a similar array structure has been utilized to develop a space filter for use as a low loss dichroic plate permitting the simultaneous single antenna transmission of both X and S band energy. Such an arrangement is described in U.S. Pat. No. 3,769,623.

SUMMARY

The present invention is addressed to an improved space filter, one important utility of which resides in its use as a radome structure for aircraft and the like. The filter is characterized in exhibiting a substantial immunity from loss of transmission or reception at the resonant frequency of interest over a variation of radiation angles of incidence. Further evidencing quality boresight performance, the geometry of the periodic filter array is such as to improve its mechanical structural integrity through the elimination of "island" profiles in filter component definition. The latter aspect of the invention serves to facilitate its fabrication through the elimination of a need for supportive dielectric substrates and through the availability of dual surface chemical machining procedures.

Another feature and object of the invention provides for a period array of filter components which can be closely nested or spaced under rigid design criteria, while still avoiding loss of structural integrity as a consequence of the proximity of portions of those components.

A further feature and object of the invention is to provide a space filter of a variety incorporating a surface disposed array of recurrent filter components arranged in a periodic pattern. The filter components are formed as a pair of thin elements each extending from a terminal portion thereof to define linear portions which are mutually disposed at an internal angle of about 120°. Intermediate the linear portions is a reactive load preferably formed in loop or U-shaped fashion and connected at the terminal portion. From the linear portions of each element there extends an outward, "flaired", portion which is integral therewith and extends from each element to provide, upon combining clusters of the element, a mutual parallel relationship. The clusters within the array are arranged in a triangular grid, the height of the triangular geometry defining that grid being less one half of the wave length of the resonant frequency of interest. The clusters within the recurrent or periodic pattern of the array are closely nested by placing the load loop structure of one filter component in adjacency with the mutually disposed outward, "flaired", portions of the thin elements of each filter component.

Other objects of the invention will, in part, be obvious and will, in part, appear hereinafter.

The invention, accordingly, comprises the apparatus possessing the construction, combination of elements and arrangement of parts which are exemplified in the following detailed disclosure. For a further understanding of the nature and objects of the invention, references should be had to the following detailed description taken in connection with the accompanying drawings.

DETAILED DESCRIPTION

Figure 1:
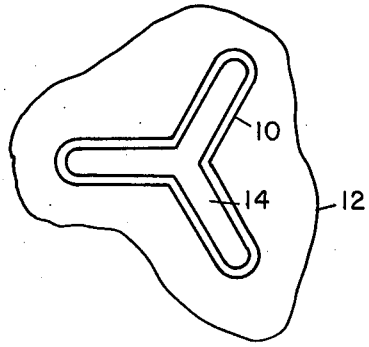
FIG. 1 is an enlarged plan view of a slot filter component utilized in earlier radome applications.

FIG. 1 illustrates an earlier development in a slot array intended for an aircraft radome. Note that the slot at 10, formed within a thin metallic surface 12 supported by a dielectric substrate (not shown) exhibits a generally "Y" shaped geometry which was particularly selected to derive an enhanced performance in conical shaped radomes. The design of the slot 10 evolved from earlier theory establishing that arrays of straight half-wave length slots exhibit sizable shifts in resonance for varying incidence angles. In this regard reference is made to the following publications:

II. B. A. Munk, R. G. Kouyoumjian, and L. Peters, Jr., "Reflection Properties of Periodic Surfaces of Loaded Dipoles," IEEE Trans. Antennas Propagat., vol. AP-19, pp. 612–617, Sept. 1971

III. C. C. Chen, "Transmission of Microwave through Perforated Flat Plates of Finite Thickness," IEEE Trans. Microwave Theory Tech., vol. MTT-21, pp. 1–6, Jan. 1973.

Such straight slots generally are considered unsuitable for the broad angle of incidence encountered in a streamlined radome. Publication II above also describes that shorter slots, capacitively loaded at their centers may be employed to stabilize an array resonant frequency over a relatively broadened range of incidence angles. A bipolar slot geometry in the shape of a cross has been developed for applications requiring arbitrary polarization. However, the geometry shown at 10 was early found preferable for a radome application inasmuch as a triangular grid structure of the clustered elements was found more suitable for maintaining the required periodicity on a radome shape as well as providing superior resonant frequency stability in applications where the signal polarization varies with respect to grid orientation. A more detailed discourse concerning the geometry of arrays utilizing the structure at 10 is provided in publication I, above.

Looking further to the geometric shape of slot 10, it may be noted that the slot fully surrounds what amounts to a floating metal insert 14. This insert must be supported upon the dielectric substrate of the structure. Accordingly, the structure itself must rely for its mechanical integrity upon the adhesion of island 14 to the substrate. Additionally, inasmuch as the slot arrays are fabricated by a photo-etching technique the thickness of the metal substrate 12 which can be accommodated becomes limited inasmuch as etching can only be carried out from one surface of the structure. Additionally, plating techniques requiring electrical continuity cannot be employed to form the structure formed.

Figure 3:
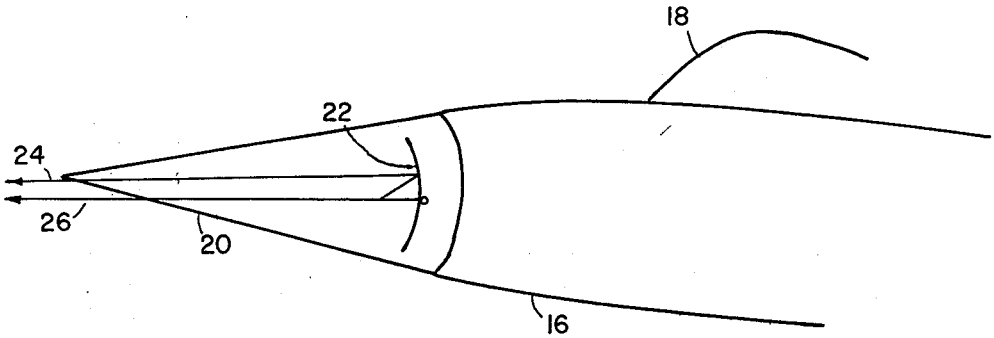
FIG. 3 is a schematic representation of a conical radome in conjunction with a high performance aircraft profile.

Looking to FIG. 3, an aircraft mounted radome application for a space filter is represented in generalized, schematic fashion. The figure shows the airframe of an aircraft at 16 including a cockpit canopy 18 and a conically shaped metallic radome 20. Within radome 20 there is schematically represented a dish-type antenna 22 of conventional structure from which electromagnetic radiation is projected as represented by vectors 24 and 26. Rotation of antenna 22 will be seen to require projection into radome 20 at a broad variety of angles of incidence.

Figure 2:
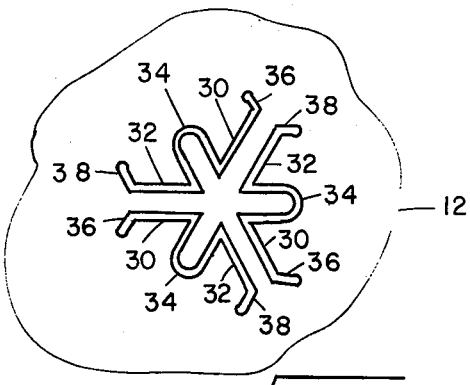
FIG. 2 is a filter component in slot configuration according to the present invention.

Looking to FIG. 2 a configuration for a space filter according to the present invention is revealed. Shown in a slot embodiment, the configuration is formed of a cluster of three filter components. Each of these filter components is formed having a pair of thin, somewhat elongate linear portions 30 and 32 which are coupled at their terminal portions to a capacitive, reactive load 34. Capacitive, reactive loads as at 34 serve to stabilize the resonant frequency of the filter surface with respect to the incident angle and polarization characteristics of impinging electromagnetic radiation. In providing an analysis of scattering by a two-dimensional array of loaded dipoles, publications II and III necessarily consider the loading, $Z_L$ (inductive-reactive in the case of dipole theory and capacitive-reactive in the case of complementary slot theory) for the multi-element arrays. Such loading, $Z_L$, as described in virtually all electromagnetic texts, is defined by the general formula:

$$Z_L = jZ_O \tan \beta l,$$

where $Z_O$, is the characteristic impedance, $\beta = 2\pi/\lambda$ ($\lambda$ being wavelength) and, $l$, being the length of the element longitudinal component (30, 32 in the embodiment of FIG. 2). The above referenced U.S. Pat. No. 3,789,404 provides further elaboration upon loading, particularly as related to dipole elements within arrays. Through the principle of duality, the loading considerations therein described concerning dipoles are correspondingly applied to the design of arrays of loaded slots. Load 34 is geometrically shaped as a loop or a "U", one termini of each side of which is coupled to the aforesaid corresponding element terminal portion. Note, additionally, that load loops 34 extend outwardly between respective linear portions 30 and 32 of each filter component. Each of the linear portions 30 and 32, respectively, is fashioned having an outwardly disposed portion, shown respectively at 36 and 38, which extends to a terminus. Linear portions 30 and 32 are mutually disposed at an internal angle of 120°, while the outward portions thereof at 36 and 38 are mutually parallel as well as being parallel to the sides of the load loops 34. As is apparent from the figure, the linear portions 30 and 32 also may be described as being symmetrically disposed about, and at an angle of about 60°, with respect to an imaginary axis bisecting them. Generally, the combined lengths of extended portions 36 and 38, linear portions 30 and 32 and load loop 34 will be on the order of one half of the wave length of the selected resonant frequency of the filter. It further may be observed that the filter components within the recurring clusters of three thereof are arranged in a symmetrical fashion in close mutual adjacency. Additionally, the adjacent linear portions, as at 30 and 32, are arranged in a spaced, parallel relationship the clustering also may be described as one wherein the above-described imaginary axis of any given one of the three filter components is disposed with respect to an adjacent other one of those axes at an angle of about 60° thus deriving the noted symmetry thereof. As indicated above, for radomes applications, it is appropriate to employ a triangular grid structure of the clustered elements. This form of grid structure is more suitable for maintaining the required surface periodicity on the structure as well as providing for resonant frequency stability under signal polarization variations with respect to grid orientation.

Figure 4:
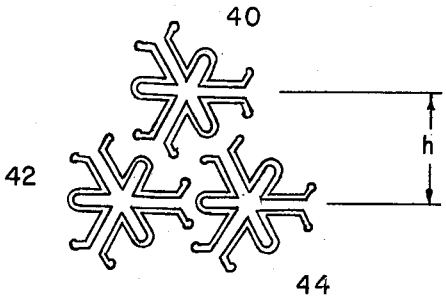
FIG. 4 is a plan view of a triangular grid of three filter components arranged according to the invention.

Looking to FIG. 4, such a triangular grid geometry is revealed, the figure showing three element clusters represented generally at 40, 42, and 44. FIG. 4 additionally reveals that the triangular geometry forming the grid has a triangledefined height h of less than one half of the wave length of the characteristic resonant frequency of the filter. Looking additionally to FIG. 5, it may be observed that this height also may be represented as the distance between adjacent rows of recurring clusters of filter components within the array.

Figure 5:
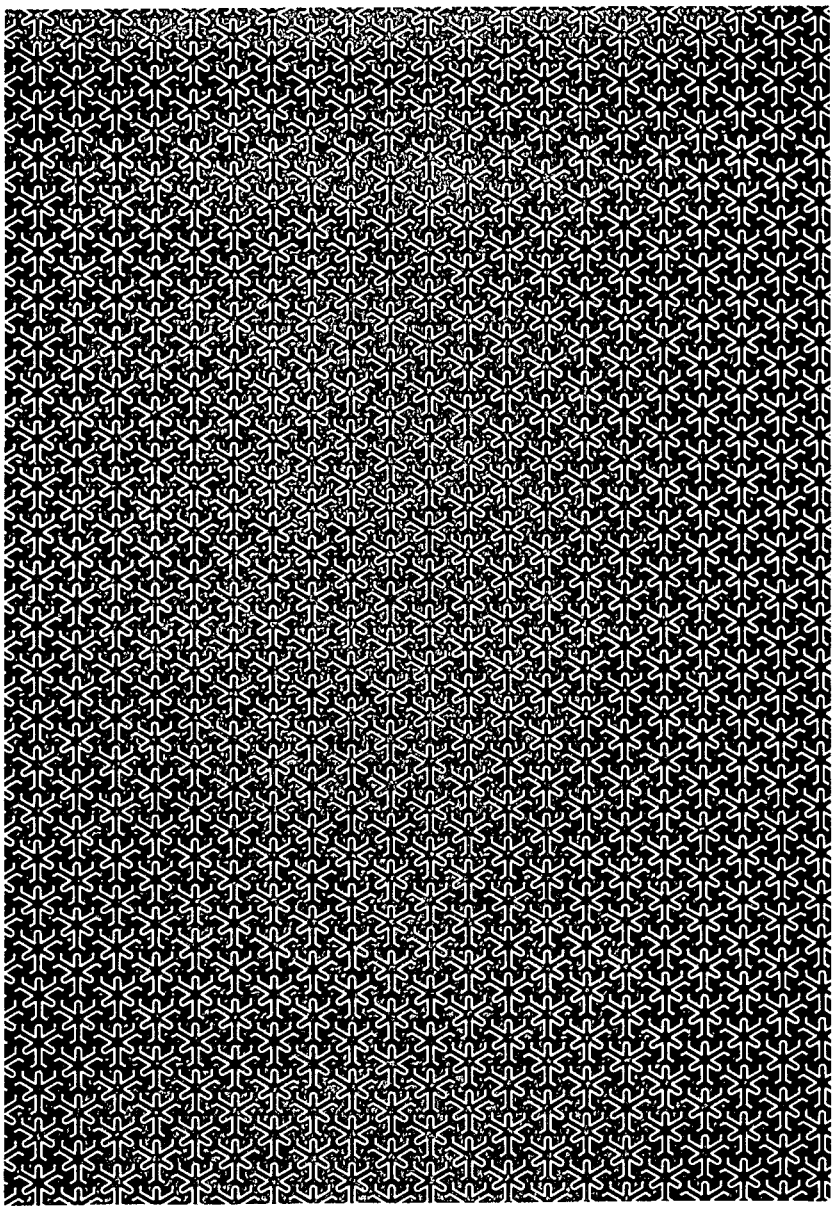
FIG. 5 is a photographic representation of a periodic array of filter components according to the invention.

FIGS. 4 and 5, additionally reveal an important aspect of the invention as it resides in the geometry of the outwardly extending or "flared portions" 36 and 38 of each element. With the arrangement of the invention, a closer nesting of the clusters is available, inasmuch as the load loops 34 can be positioned in alignment with outwardly extending portions 36–38. As a consequence, the mechanical integrity of the array is assured while the necessary close spacing of the clusters remains available.

In the discourse to follow, performance tests of a slotted copper conical radome having a length of 6 feet 4 inches and a base diameter of 25.5 inches are described. The slotted copper surface of the radome was approximately 64% metal and no supporting dielectric was used for purposes of either filling the slots or as a supporting substrate. All data deriving the results were taken at the radome's 14.55GHz center frequency, i.e. at resonance.

Figure 7:
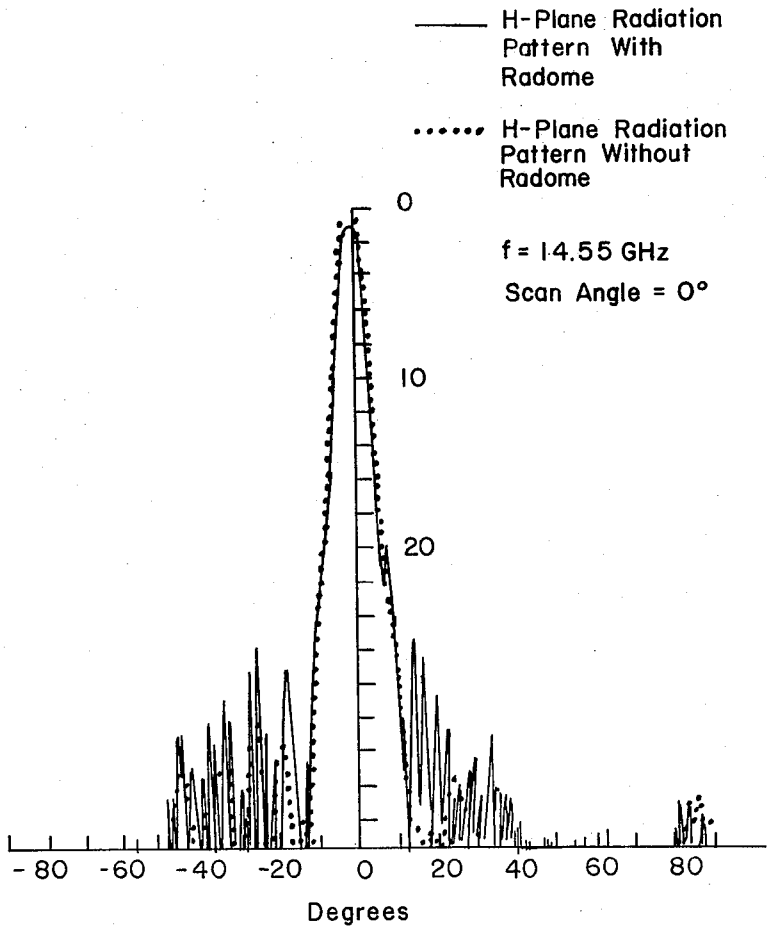
FIG. 7 shows measured H-plane radiation corresponding to the measurement depicted in connection with FIG. 6.
Figure 6:
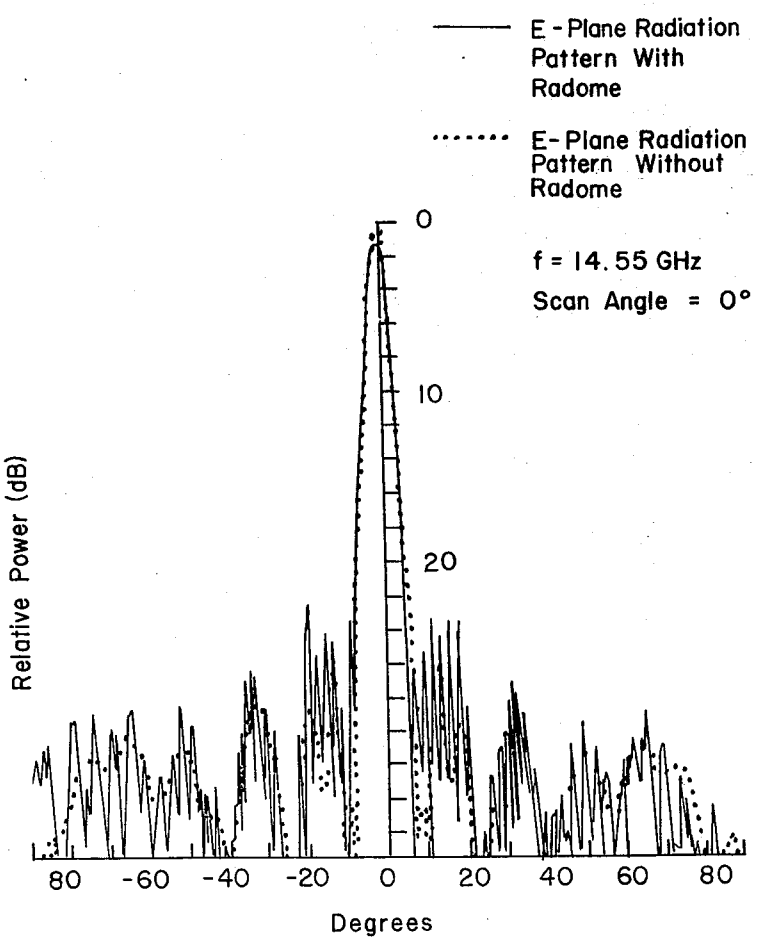
FIG. 6 represents the result of the measured E-plane radiation pattern of a parabolic transmitting antenna, taken with and without a radome configured according to the invention at a scan angle of 0°.
Figure 9:
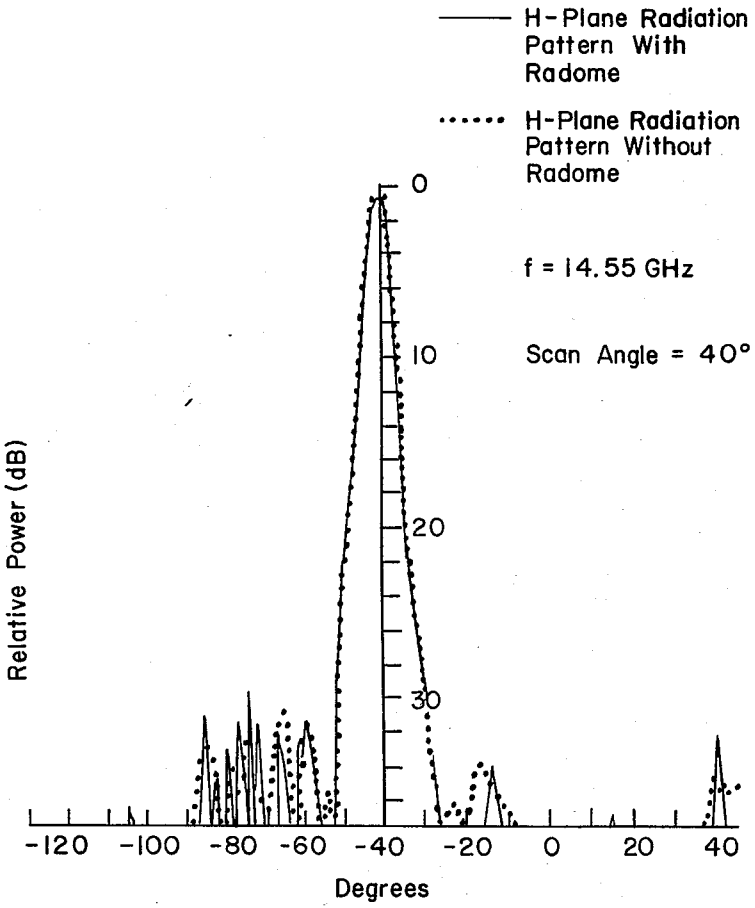
FIG. 9 shows the results of measuring the H-plane radiation pattern of the arrangement of FIG. 8.
Figure 8:
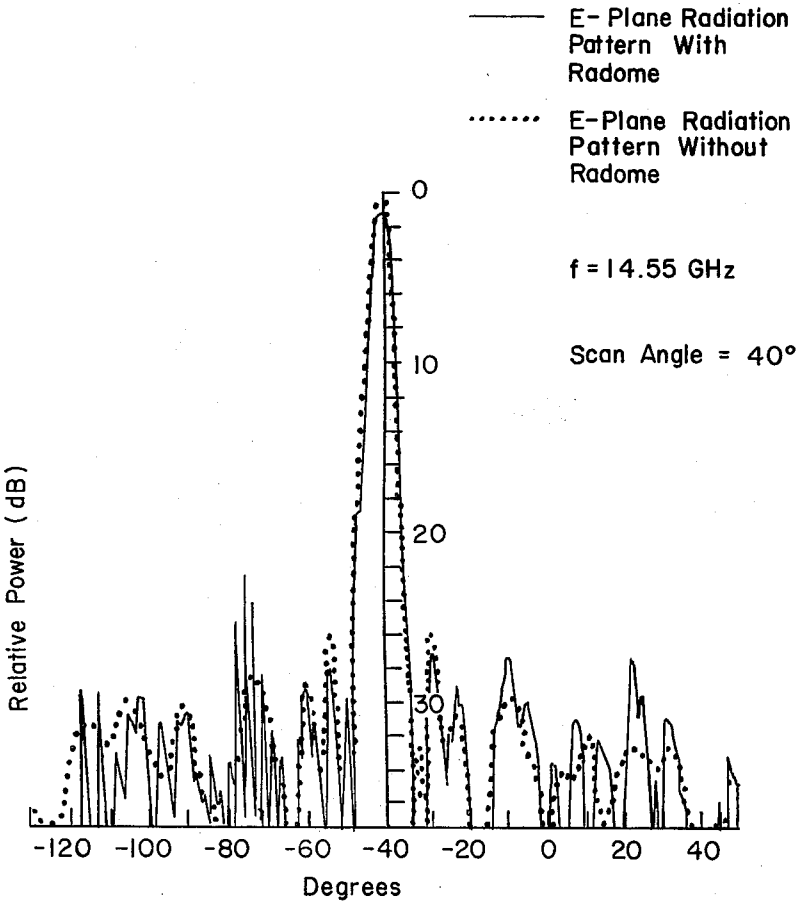
FIG. 8 shows the results of measuring the E-plane radiation pattern of a parabolic transmitting antenna taken with and without radome configured according to the invention and at a scan angle of 40°.
Figure 10A:
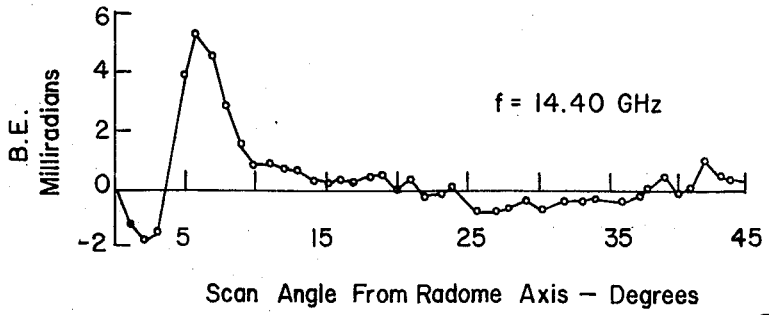
FIGS. 10A–10E show measured E-plane boresight error introduced by a radome according to the invention as a function of scan angle for selected signal frequencies around resonance, FIG. 10A representing a frequency of 14.40GHz, FIG. 10B showing a frequency of 14.50GHz, FIG. 10C showing a frequency of 14.55GHz, FIG. 10D showing a frequency of 14.60GHz, and FIG. 10E showing results at 14.70GHz.
Figure 10B:
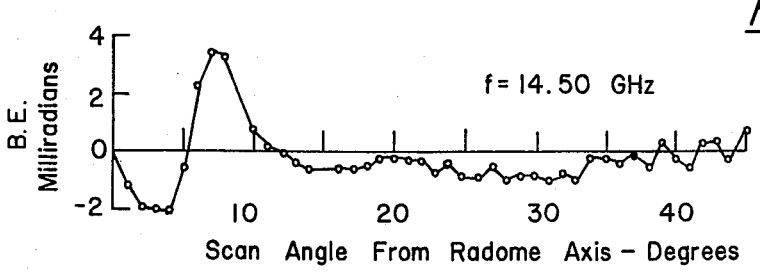
Figure 10C:
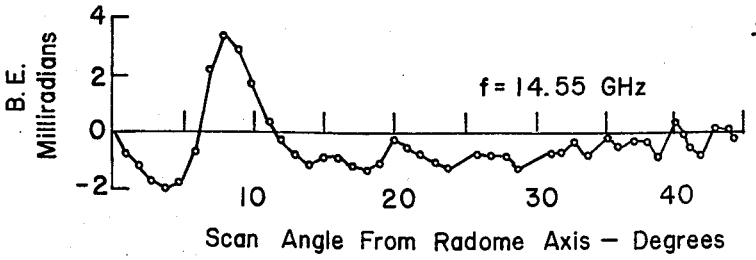
Figure 10D:
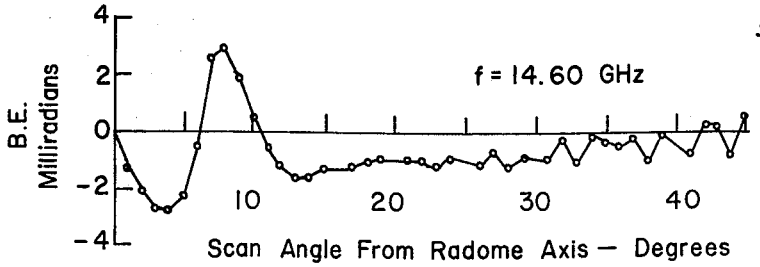
Figure 10E:
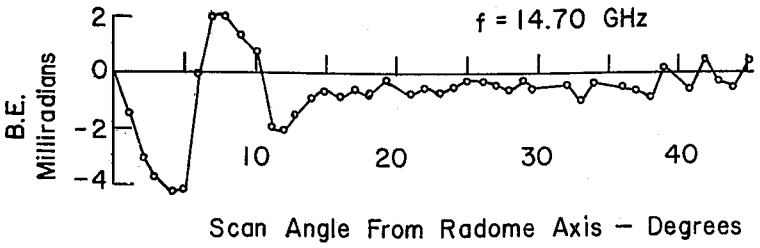
Figure 11A:
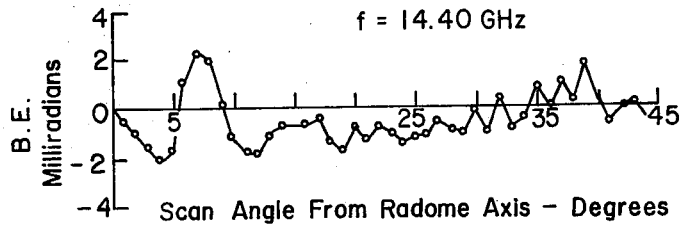
FIG. 11 shows measured H-plane boresight error introduced by a radome formed according to the invention as a function of scan angle for selected frequencies around resonance, FIG. 11A showing results at 14.40GHz, FIG. 11B showing results at 14.50GHz, FIG. 11C showing results at 14.55GHz, FIG. 11D showing results at 14.60GHz, and FIG. 11E showing results at 14.70GHz.
Figure 11B:
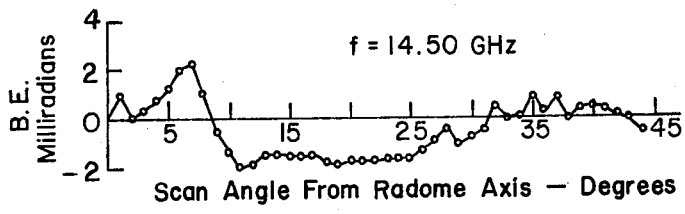
Figure 11C:
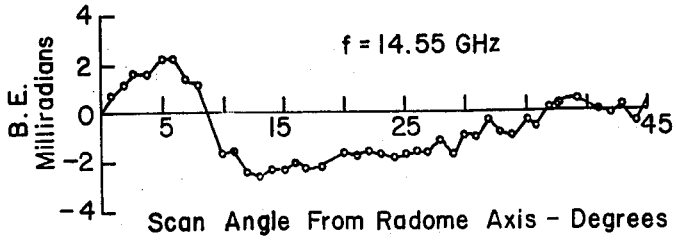
Figure 11D:
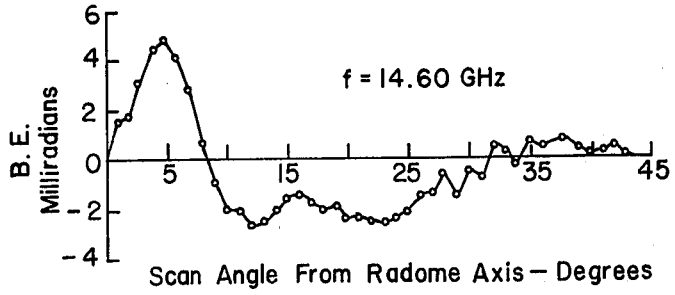
Figure 11E:
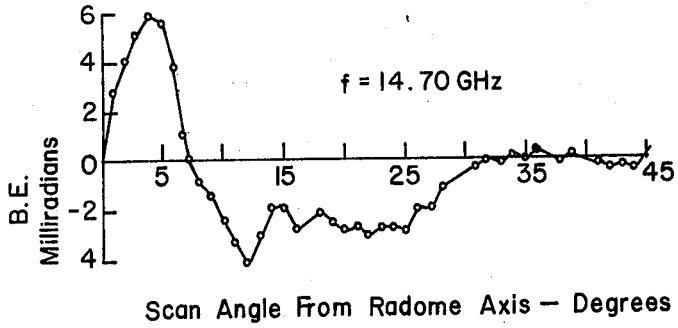

As an initial test of the quality and signal transmission through the metallic radome, a 14 inch diameter parabolic antenna was placed inside the radome and radiation patterns were measured, for selected scan angles of the antenna with respect to the radome axis. Four of these measured antenna patterns are shown in FIGS. 6–9, for fixed antenna scan angles of 0° and 40°, FIGS. 6 and 8 showing measured E-plane radiation patterns at respective scan angles of 0° and 40°. FIGS. 7 and 9 show measured H-plane radiation patterns, respectively, for 0° and 40° scan angles. These figures demonstrate that radiation patterns obtained by transmitting through the metallic radome compare well with the same patterns taken without the radome present. The patterns do show that there is less than about a 0.8dB insertion loss introduced by the radome in the mainbeam direction of the pattern regardless of scan angle or polarization. The second difference between the patterns taken with and without the metallic radome is represented by the presence of a small ripple superimposed on the side-lobe structure of the antenna pattern with the radome present and is a result of a small signal reflection within the cavity formed by the antenna and radome. Conventional dielectric radomes can be expected to exhibit similar reflection lobes.

Another important aspect of radome performance resides in the effects encountered by insertion of phase variation introduced by transmission through the radome. The effects may be evaluated by gauging boresight error. In carrying out a test on the above-described radome embodiment, the 14 inch diameter parabolic antenna was fitted with dual open-ended wave guide feeds which were phased to obtain a pattern null in the direction of the antenna axis. A receiving horn was mounted on a slotted-line carriage, positioned perpendicular to the line of sight between the two antennas, at a range of 10 meters from the parabolic transmitting antenna. To obtain the boresight error at a specific scan angle from the radome axis, the radome was rotated to the desired axis angle, the receiving antenna was moved along the slotted-line carriage, and the position of the antenna pattern null was recorded from the Vernier scale on the slotted-line carriage. The radome was then rotated out of the signal path and the null position without the radome present was again determined and recorded. The boresight error was then obtained by dividing the difference between the null locations, obtained with and without the radome present, by the range between the parabolic transmitting antenna and receiving horn. For a range of 10 meters, one centimeter displacement of the null corresponds to one milliradian (mrad) boresight error.

Measured E- and H-plane boresight error curves for signal frequencies of 14.4, 14.5, 14.55, 14.6 and 14.7 GHz are shown, respectively, in FIGS. 9A–9E and 10A–10E. The boresight error data are shown plotted as a function of antenna scan angle for scan angles in the range of 0° to 45°. In the figures, a positive value of boresight error indicated that the direction of transmitted signal is deflected away from the radome axis direction. Inversely, a negative boresight error value means that the signal is deflected toward the radome axis by the amount of boresight error. Examination of curves of FIGS. 9A–9E and 10A–10E reveals that boresight error values are quite small over the entire frequency range from 14.4 to 14.7 GHz. Specifically, the E-plane boresight error at the center frequency of 14.55 GHz (FIG. 9C) has a maximum value of 3.4 milliradians at a scan angle of about 8°, with the values elsewhere over the 0° to 45° range being, for the most part, less than 1 milliradian. The H-plane boresight error curve at resonance (FIG. 10C) shows similar performance, with a peak boresight error of 2.5 milliradians.

Since certain changes may be made in the above inventive apparatus without departing from the scope of the invention herein involved, it is intended that all matter contained in the above description or shown in the accompanying drawings shall be interpreted as illustrative and not in a limiting sense.

What is claimed is:

1. In a space filter of a variety incorporating a surface disposed array of recurrent filter components mutually arranged in a periodic pattern, the improvement comprising:

a surface incorporating a cluster of three discrete mutually spaced filter components, each said component comprising a pair of thin elements each extending from a terminal portion thereof to define linear portions, said linear portions being symmetrically disposed about, and at an angle of about 60°, with respect to an axis bisecting them;

means defining a reactive load connected with each said terminal portion and configured as a loop symmetrically disposed about said axis and extending outwardly between said linear portions; and the said axis of any given one of said three filter components being disposed with respect to an adjacent other one of said axes at an angle of about 60° whereby said filter components within said cluster are mutually symmetrically disposed; and the adjacent linear portions of said three filter components being mutually spaced and defining an open ended surface region whereby all portions of said surface are present in the array and in a continuous fashion.

2. The improved filter component of claim 1 wherein a said element is configured having an outward portion integral with and extending from said linear portion a predetermined distance to a terminus and mutually oppositely disposed at an internal angle greater than said 60°.

3. The improved filter component of claim 1 in which said recurrent filter components are present as slots within a conductive surface to provide a band-pass function.

4. The improved filter component of claim 1 in which said recurrent filter components are present as conductive dipole elements to provide a band stop function.

5. The improved filter component of claim 1 in which said means defining a reactive load loop configuration is geometrically shaped as a, U, one termini of each side of which is coupled to a corresponding said element terminal portion; and each said element is configured having an outward portion extending from said linear portion a predetermined distance to a terminus and in paralleled relationship with an adjacent said U side.

6. The improved filter component of claim 1 wherein each said element is configured having an outward portion integral with and extending from said linear portion a predetermined distance and disposed in parallel relationship with said bisecting axis.

7. The improved filter component of claim 6 in which said outward portion predetermined distance is less than the length of an associated said linear portion.

8. A space filter comprising:

a periodic array of recurrent filter components present as slots within a conductive surface, each said filter component including;

a pair of thin, elongate elements each extending from a terminal portion thereof to define linear portions said linear portions being symmetrically disposed about, and at an angle of about 60°, with respect to an axis bisecting them;

means defining a capacitive, reactive load formed as a slot within said conductive surface and connected with each said terminal portion of the said linear portions of a said pair of elements and extending outwardly in the form of a loop symmetrically disposed about said axis; and said filter components being positioned within said array in recurring clusters of three discrete components arranged symmetrically in close mutual adjacency, the said axis of any given one of said three filter components being disposed with respect to an adjacent other one of said axes at an angle of about 60°, the adjacent linear portions of said three filter components being mutually spaced and defining an open ended surface region whereby all portions of said conductive surface are present within said array in continuous integrally associated fashion.

9. The space filter of claim 8 wherein each said element is configured having an outward portion integral with and extending from said linear portion a predetermined distance to a terminus and mutually oppositely disposed at an internal angle greater than 60°.

10. The space filter of claim 8 in which the distance between adjacent rows of said recurring clusters of filter components within said periodic array is less than one half the wavelength of the resonant frequency selected for filter performance.

11. The space filter of claim 8 in which:

each said element is configured having an outward portion integral with and extending from said linear portion a predetermined distance to a terminus and mutually oppositely disposed at an internal angle greater than 60°, and the distance between adjacent rows of said recurring clusters of filter components within said periodic array is less than one half the wavelength of the resonant frequency selected for filter performance.

12. The improved filter component of claim 8 wherein each said element is configured having an outward portion integral with and extending from said linear portion a predetermined distance and disposed in parallel relationship with said bisecting axis.

13. The improved filter component of claim 8 in which said outward portion predetermined distance is less than the length of an associated said linear portion.

* * * * *